US006951483B2

(12) United States Patent
Kameyama

(10) Patent No.: US 6,951,483 B2
(45) Date of Patent: Oct. 4, 2005

(54) COAXIAL CABLE SHIELDING TERMINAL

(75) Inventor: Isao Kameyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/822,834

(22) Filed: Apr. 13, 2004

(65) Prior Publication Data

US 2004/0203286 A1 Oct. 14, 2004

(30) Foreign Application Priority Data

Apr. 14, 2003 (JP) ..... P2003-109224

(51) Int. Cl.[7] ..... H01R 9/05
(52) U.S. Cl. ..... 439/595; 439/99
(58) Field of Search ..... 439/585, 578–584, 439/99

(56) References Cited

U.S. PATENT DOCUMENTS 3,670,293 A * 6/1972 Garver ..... 439/585
3,699,504 A * 10/1972 Huber ..... 439/585
4,269,469 A * 5/1981 Audic ..... 439/424
5,246,384 A * 9/1993 Sato ..... 439/585
5,603,636 A * 2/1997 Kanou et al. ..... 439/585
6,206,727 B1 * 3/2001 Aoyama et al. ..... 439/585
6,384,335 B1 * 5/2002 Saito et al. ..... 174/74 R
6,554,644 B2 * 4/2003 Koide ..... 439/585
6,709,290 B2 * 3/2004 Yoshida ..... 439/585

FOREIGN PATENT DOCUMENTS

JP 5-90855 U 12/1993

* cited by examiner

*Primary Examiner*—Gary Pauman
(74) *Attorney, Agent, or Firm*—Sughrue Mion, PLLC

(57) ABSTRACT

A coaxial cable shielding terminal for electrically connected at an end of a coaxial wire, comprising a press-clamping portion including a pair of braid press-fastening portions which extend in a generally upstanding manner respectively from opposite side edges of a terminal bottom plate portion, and can be press-connected to a braid of the coaxial wire by press-fastening, and a connection piece which is inserted at its distal end portion between an inner insulating layer of the coaxial cable and the braid from the end side of the coaxial cable so that the braid can be held between the connection piece and distal end portions of the braid press-fastening portions. A retaining portion is projected from an inner surface of each of the braid press-fastening portions so as to block the connection piece to be displaced toward a conductor core of the coaxial cable during the press-fastening operation.

4 Claims, 6 Drawing Sheets

COAXIAL CABLE SHIELDING TERMINAL

The present application is based on Japanese Patent Application No. 2003-109224, the entire contents of which are incorporated herein by reference.

BACKGROUND OF THE INVENTION

1. Field of the Invention

This invention relates to a shielding terminal for a coaxial cable, and more particularly to an improved coaxial cable shielding terminal which has a press-clamping portion for press-connection to an end portion of the coaxial cable, and is electrically connected to a braid of the coaxial cable exposed at the end portion thereof.

2. Related Art

Generally, in order to intercept electrical noises such as electromagnetic waves and static electricity, a coaxial cable, used as an antenna wire or the like, has a construction in which a conductor core is covered with an inner insulating layer, and this inner insulating layer is covered with a braid, and further this braid is covered with an insulating sheath.

There have been proposed various coaxial connectors for connecting such a coaxial cable to a mating equipment or a mating connector.

A coaxial cable shielding terminal for connecting the braid of the coaxial cable to the mating connector for grounding purposes is used in such a coaxial connector, and one example thereof is shown in FIGS. 6 and 7 (see, for example, JP-UM-A-5-90855).

The conventional coaxial cable shielding terminal 11, shown in FIG. 6, is a press-shaped product formed of a metal sheet, and a connector mounting portion 13 is provided at a distal end portion thereof, while a press-clamping portion 14 for press-connection to the coaxial cable 1 is provided at a proximal end portion thereof.

In the coaxial cable 1, an insulating sheath 3 and a braid 5, provided inside this insulating sheath, are cut off over a predetermined length to expose two core wires 7, and then a distal end portion of an inner insulating layer 7*b* of each core wire 7 is cut off to expose a conductor core 7*a*, and then a wire press-clamping terminal (not shown) is press-clamped to a distal end portion of the conductor core 7*a*, and these terminals are mounted on a connector 15.

The connector mounting portion 13 includes a pair of side walls 13*a* and 13*a* extending upright respectively from opposite side edges of a terminal bottom plate portion 11*a* at a distal end portion thereof, and a connector housing 15 (to which the core wires 7 are connected) is held between these side walls 13*a* and 13*a*, and this connector mounting portion 13 is covered with a cover 25 as shown in FIG. 7.

The press-clamping portion 14 has a connection piece 12 provided between a pair of press-fastening portions 14*a* and 14*b*, and this connection piece 12 is inserted between the braid 5 of the coaxial cable 1 and the inner insulating layer 7*b* disposed inside this braid.

An interconnecting portion 12*a* is formed on an upper edge of one side wall 13*a*, and is spaced a predetermined distance forwardly from the press-fastening portion 14*a*, and is bent toward the terminal bottom plate portion 11*a*, and the connection piece 12 is folded back toward the rear end in generally parallel, spaced relation to the press-fastening portion 14*a* through the interconnecting portion 12*a*, and is curved into an arcuate cross-section so as to be disposed along the outer peripheral surface of the core wire 7.

For connecting the coaxial cable shielding terminal 11 to the coaxial cable 1, the connection piece 12 is inserted between the braid 5 and the inner insulating layer 7*b*, and in this condition the pair of press-fastening portions 14*a* and 14*b* are press-fastened on the insulating sheath 3.

As a result, the press-fastening portion 14*a* presses and urges the insulating sheath 3 and the braid 5 toward the connection piece 12, so that the connection piece 12 is held in intimate contact with the inner peripheral surface of the braid 5 as shown in FIG. 8, and therefore a good electrically-connected condition is obtained between the braid 5 and the coaxial cable shielding terminal 11 via the connection piece 12.

In the above coaxial cable shielding terminal 11, however, when the press-fastening portion 14*a* of the press-clamping portion 14 was press-fastened, the connection piece 12 was displaced toward the conductor core 7*a* (as indicated by arrow A in FIG. 8) by the pressing force applied during this press-fastening operation. The deformed connection piece 12 bit into the inner insulating layer 7*b*, so that the braid 5 could not be sufficiently compressed, and in some cases, a good electrically-connected condition could not be obtained.

And besides, when the thus deformed connection piece 12 squeezed the inner insulating layer 7*b* around the conductor core 7*a*, the distance between the conductor core 7*a* and the braid 5 was changed (that is, the ratio (d1/d2) of the diameter d1 of the conductor core 7*a* to the outer diameter d2 of the inner insulating layer 7*b* therearound was changed), and this invited a problem that an impedance in the coaxial cable 1 was disturbed, thereby adversely affecting high-frequency characteristics.

SUMMARY OF THE INVENTION

It is therefore an object of this invention to solve the above problems, and more specifically to provide a coaxial cable shielding terminal which can make stable electrical connection to a braid of a coaxial cable, and will not adversely affect high-frequency characteristics of the coaxial cable by the press-connection of this shielding terminal.

(1) The above object of the present invention has been achieved by A shielding terminal for a coaxial cable, comprising:

a press-clamping portion for being press-connected to an end portion of a coaxial cable, wherein said shielding terminal is electrically connectable to a braid of said coaxial cable exposed at the end portion thereof;

wherein said press-clamping portion includes a pair of braid press-fastening portions extending in a generally upstanding manner respectively from opposite side edges of a terminal bottom plate portion, and being press-connected to said braid by press-fastening, a connection piece inserted at a distal end portion thereof between an inner insulating layer of said coaxial cable and said braid from an end side of said coaxial cable so that said braid is held between said connection piece and distal end portions of said braid press-fastening portions, and a retaining portion projecting from an inner surface of at least one of said braid press-fastening portions to block the connection piece to be displaced toward a conductor core of said coaxial cable during the press-fastening operation.

In the coaxial cable shielding terminal of the above construction, there is effected a cable end-processing step in which an exposed portion of the conductor core and an exposed portion of the braid are provided by removing an insulating sheath and the inner insulating layer respectively over predetermined lengths from the end portion of the coaxial cable, and thereafter the connection piece is inserted between the braid and the inner insulating layer at the end portion of the coaxial cable, and in this condition the pair of braid press-fastening portions are press-fastened on the braid.

As a result, the braid press-fastening portions press and urge the braid toward the connection piece, so that the connection piece is held in intimate contact with the inner peripheral surface of the braid. Therefore, the braid is held between the connection piece and the braid press-fastening portions, so that a good electrically-connected condition can be obtained between the braid and the coaxial cable shielding terminal.

Although a press-fastening force, applied to the braid press-fastening portions during the press-connecting operation, presses and urges the braid and the connection piece toward the conductor core, the retaining portion, formed on and projecting from the inner surface of each of the braid press-fastening portions, limits the displacement of the connection piece toward the conductor core, and therefore there will not be encountered a situation in which the deformed connection piece squeezes the inner insulating layer.

Therefore, during the press-connecting operation, the squeezing of the inner insulating layer (within the coaxial cable) which disturbs an impedance will not occur, and therefore high-frequency characteristics of the coaxial cable will not be adversely affected by the press-connection of the shielding terminal.

(2) The above object of the invention has also been achieved by a coaxial cable shielding terminal which is characterized in that a plurality of retaining portions are formed on the inner surface of said one braid press-fastening portion, and are arranged generally in a longitudinal direction of the connection piece.

In the coaxial cable shielding terminal of this construction, the plurality of retaining portions are formed on the inner surface of each of the braid press-fastening portions, and are arranged generally in the longitudinal direction of the connection piece, and therefore even when the press-fastening force acts on the connection piece during the press-connecting operation, the retaining portions support the connection piece, thereby preventing the connection piece from being inclined.

DETAILED DESCRIPTION OF THE PREFERRED EMBODIMENTS

One preferred embodiment of a coaxial cable shielding terminal of the present invention will now be described in detail with reference to the accompanying drawings.

Figure 1:
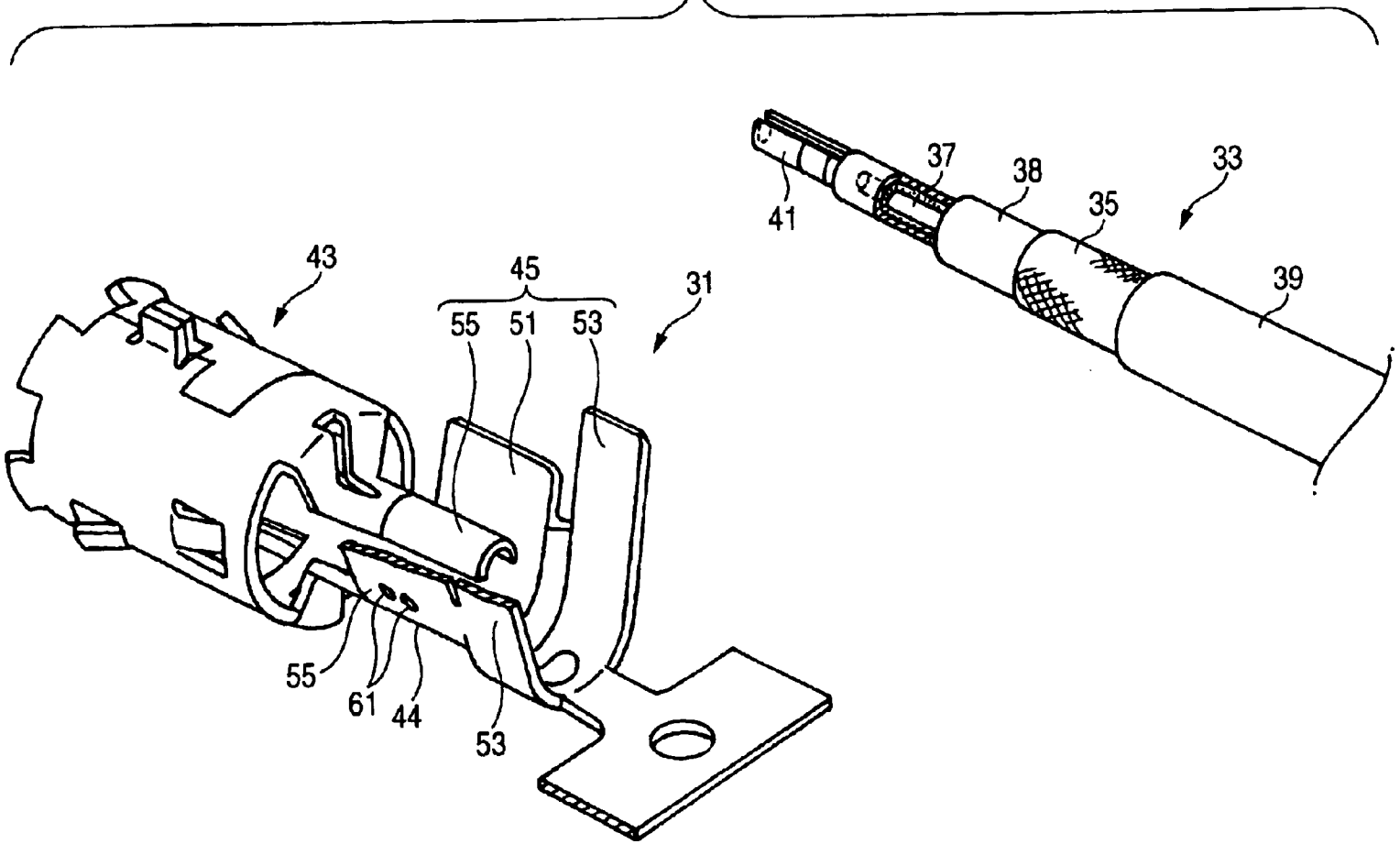
FIG. 1 is a perspective view of one preferred embodiment of a coaxial cable shielding terminal of the present invention, showing its overall construction.
Figure 2:
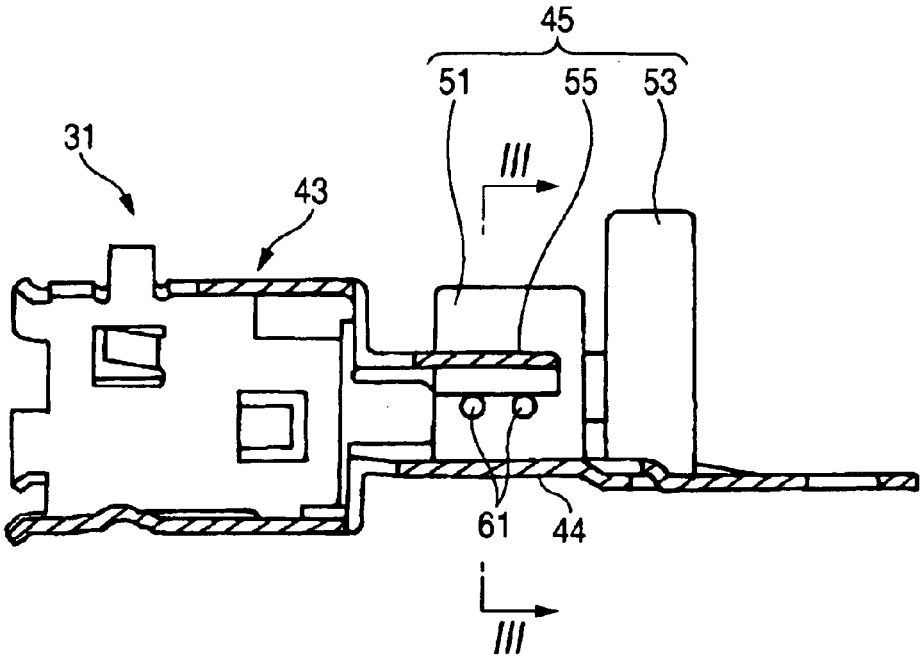
FIG. 2 is a longitudinal cross-sectional view of the coaxial cable shielding terminal of FIG. 1.
Figure 3:
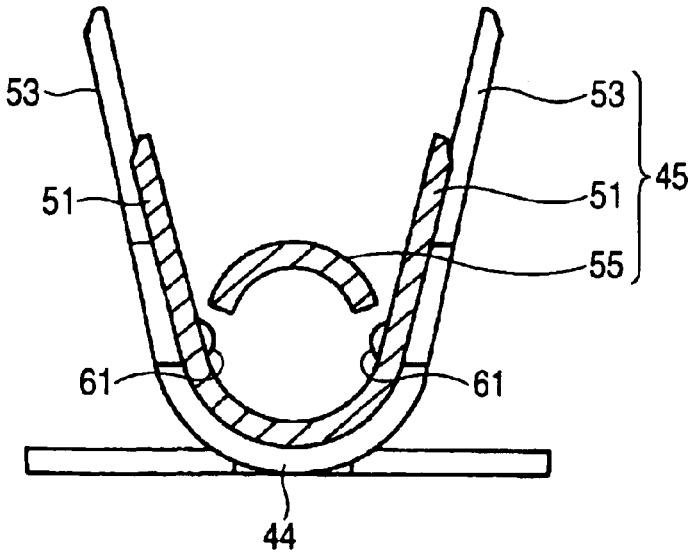
FIG. 3 is a cross-sectional view taken along the line III—III of FIG. 2.
Figure 4:
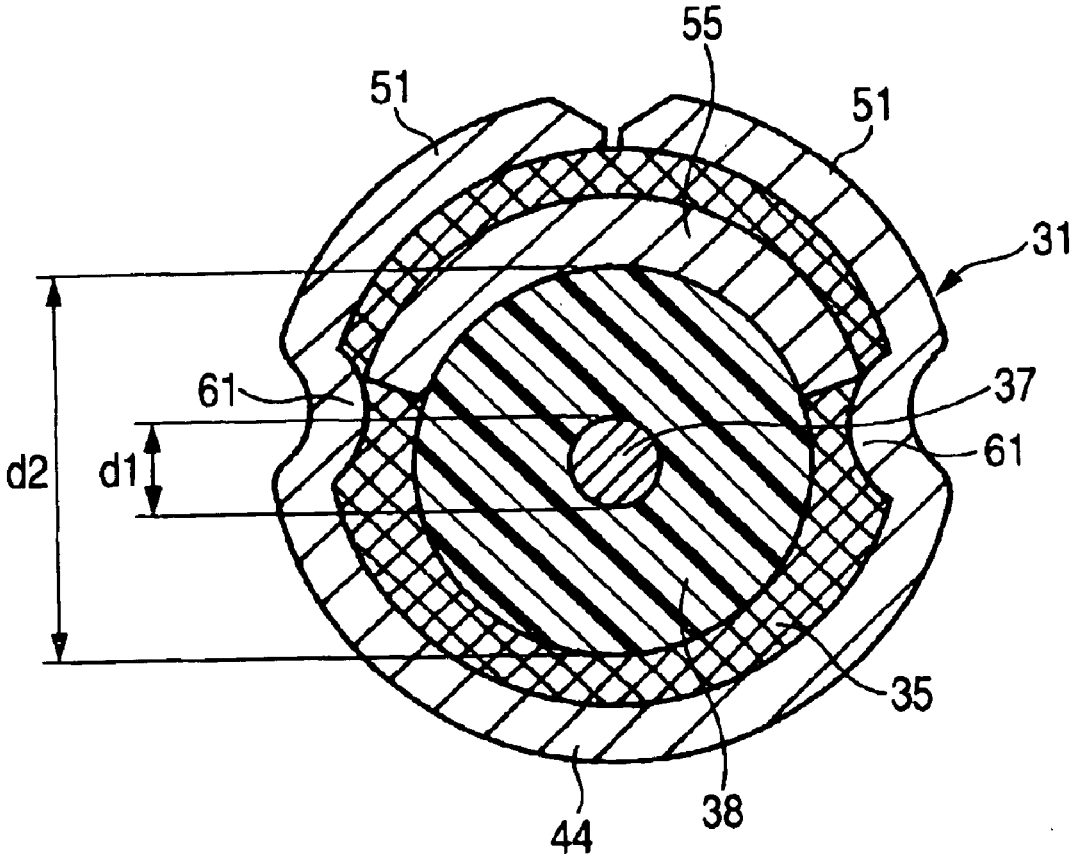
FIG. 4 is an enlarged transverse cross-sectional view of a press-clamping portion of the coaxial cable shielding terminal of FIG. 1.

FIG. 1 is a perspective view of one preferred embodiment of the coaxial cable shielding terminal of the invention, showing its overall construction, FIG. 2 is a longitudinal cross-sectional view of the coaxial cable shielding terminal of FIG. 1, FIG. 3 is a cross-sectional view taken along the line III—III of FIG. 2, and FIG. 4 is an enlarged transverse cross-sectional view of a press-clamping portion of the coaxial cable shielding terminal of FIG. 1.

As shown in FIGS. 1 and 2, the coaxial cable shielding terminal 31 of this embodiment is an integrally-formed product formed by pressing forming of a metal sheet, and this shielding terminal is electrically connected to a braid 35 of a single-core coaxial cable 33.

In the coaxial cable 33, the braid 35 is provided around an outer surface of an inner insulating layer 38 covering an outer periphery of a conductor core 37, and an insulating sheath 39 is provided around an outer surface of the braid 35 as shown in FIG. 1.

In the coaxial cable 33, end portions of the insulating sheath 39, braid 35 and inner insulating layer 38 are removed such that the braid 35, the inner insulating layer 38 and the conductor core 37 are exposed over predetermined lengths, respectively. Then, an inner terminal 41 of a generally cylindrical tubular shape for fitting connection purposes is press-connected to the conductor core 37, and thereafter this coaxial cable is press-connected to the coaxial cable shielding terminal 31 (see FIGS. 5A and 5B).

The coaxial cable shielding terminal 31 includes a terminal body 43 of a cylindrical tubular shape for receiving the inner terminal 41 in coaxial relation thereto, a terminal bottom plate portion 44 extending rearwardly from the terminal body 43, and a press-clamping portion 45 formed on the terminal bottom plate portion 44, and this shielding terminal 31 is formed into an integral construction, using a metal sheet.

The press-clamping portion 45 includes a pair of braid press-fastening portions 51 and 51 which extend in an upstanding manner respectively from opposite side edges of the terminal bottom plate portion 44 so as to be press-connected to the braid 35 by press-fastening, a pair of sheath press-fastening portions 53 and 53 which are disposed rearwardly of the braid press-fastening portions 51, and extend in an upstanding manner respectively from the opposite side edges of the terminal bottom plate portion 44 so as to be press-fastened on the insulating sheath 39 to thereby fix the coaxial cable 33, and a connection piece 55 which can be inserted at its distal end portion between the inner insulating layer 38 and the braid 35 from the end side of the cable.

As shown in FIGS. 1 and 2, the connection piece 55 has an arcuate plate-shaped transverse cross-section so as to be disposed along the inner peripheral surface of the braid 35, and this connection piece 55 extends from an upper portion of the terminal body 43 at a rear edge thereof, and is bent. The connection piece 55 is inserted between the inner insulating layer 38 and the braid 35 from the end side of the cable, and in this condition when the braid press-fastening portions 51 are press-fastened on the braid 35, the braid 35 is held between the connection piece 55 and the distal end portions of the braid press-fastening portions 51, so that this connection piece 55 is held in intimate contact with the inner peripheral surface of the braid 35.

In the coaxial cable shielding terminal 31 of this embodiment, a plurality of retaining portions 61 for blocking the connection piece 55 to be displaced toward the conductor core 37 during the press-fastening operation are convexly formed on the inner surface of each of the braid press-fastening portions 51 by press forming (embossing).

The two retaining portions 61 are formed on the inner surface of each of the braid press-fastening portions 51, and are arranged in a longitudinal direction of the connection piece 55. The retaining portions 61 on one braid press-fastening portion 51 are arranged in opposite to the corresponding retaining portions 61 on the other braid press-fastening portion 51 in the press-fastening operation in axial cross sections of the terminal 31 as shown in FIG. 4.

When the connection piece 55 tends to be displaced toward the conductor core 37 of the coaxial cable 33 by the press-fastening force applied to the braid press-fastening portions 51, the retaining portions 61 retain opposite side edges of the connection piece 55, thereby blocking this connection piece 55 to be displaced toward the conductor core 37 (that is, downward in the drawings) as shown in FIG. 4.

Figure 5A:
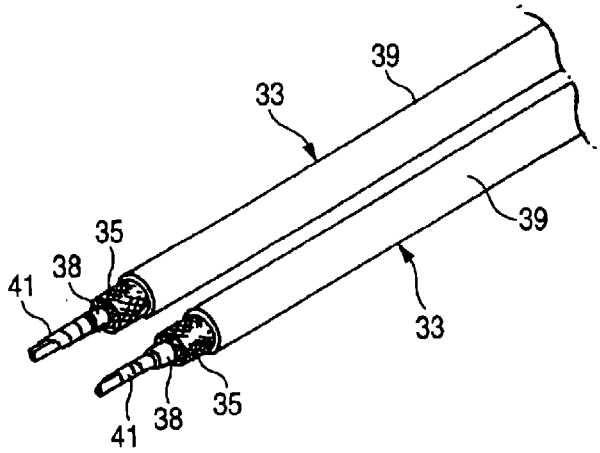
FIGS. 5A to 5C are perspective views showing the procedure of assembling a coaxial connector using the coaxial cable shielding terminal of FIG. 1.

The press-clamping portion 45 is press-fastened on the end portion of the coaxial cable 33 as shown in FIG. 5A, and by doing so, the coaxial cable shielding terminal 31 is press-connected to the end portion of the coaxial cable 33.

Figure 5B:
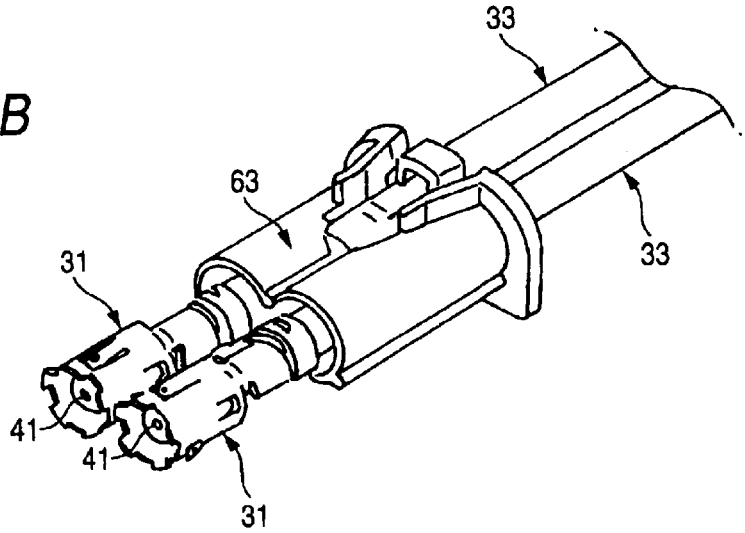
Figure 5C:
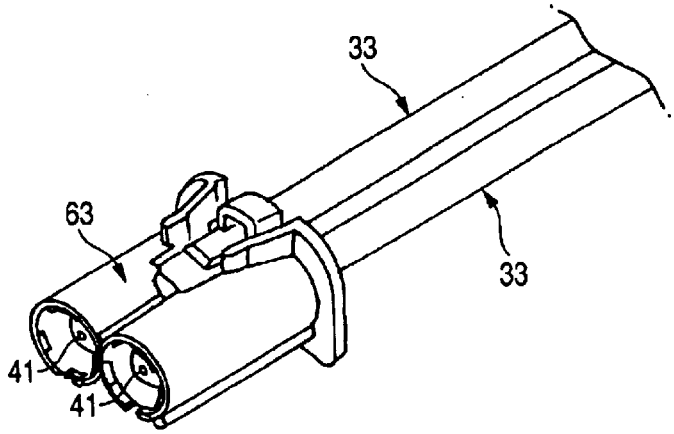

In this embodiment, the coaxial cable shielding terminal 31, press-connected to the coaxial cable 33, is received in a shielding terminal housing 63 made of an insulative resin, as shown in FIGS. 5B and 5C, and this shielding terminal housing 63 is fitted in a mating connector housing or the like, and by doing so, the coaxial cable shielding terminal 31 and the inner terminal 41 are electrically connected to their respective mating members.

Namely, in the coaxial cable shielding terminal 31 of this embodiment, there is effected the cable end-processing step in which the exposed portion of the conductor core and the exposed portion of the braid are provided by removing the insulating sheath 39 and the inner insulating layer 38 respectively over the predetermined lengths from the end portion of the coaxial cable 33, and thereafter the connection piece 55 is inserted between the braid 35 and the inner insulating layer 38 at the end portion of the coaxial cable 33, and in this condition the pair of braid press-fastening portions 51 and 51 are press-fastened on the braid 35.

As a result, the braid press-fastening portions 51 and 51 press and urge the braid 35 toward the connection piece 55, so that the connection piece 55 is held in intimate contact with the inner peripheral surface of the braid 35. Therefore, the braid 35 is held between the connection piece 55 and the braid press-fastening portions 51, so that a good electrically-connected condition can be obtained between the braid 35 and the coaxial cable shielding terminal 31.

Namely, the coaxial cable shielding terminal 31 can make stable electrical connection to the braid 35 of the coaxial cable 33 by the press-connection.

Although the press-fastening force, applied to the braid press-fastening portions 51 during the press-connecting operation, presses and urges the braid 35 and the connection piece 35 toward the conductor core 37, the plurality of retaining portions 61, formed on and projecting from the inner surface of each of the braid press-fastening portions 51, limit the displacement of the connection piece 55 toward the conductor core 37, and therefore there will not be encountered a situation in which the deformed connection piece 55 squeezes the inner insulating layer 38.

Thus, when the connection piece 55 tends to be displaced toward the conductor core 37 of the coaxial cable 33 by the press-fastening force applied to the braid press-fastening portions 51, the retaining portions 61 retain the opposite side edges of the connection piece 55, thereby blocking this connection piece 55 to be displaced toward the conductor core 37 (that is, downward in the drawings) as shown in FIG. 4.

Particularly, the two retaining portions 61 are formed on the inner surface of each of the braid press-fastening portions 51, and are arranged in the longitudinal direction of the connection piece 55, and therefore the retaining portions 61 cooperate with each other to positively keep the connection piece 55 in a horizontal condition.

Therefore, the ratio (d1/d2) of the diameter d1 of the conductor core 37 to the outer diameter d2 of the inner insulating layer 38 therearound is not changed during the press-clamping operation, so that an impedance is not disturbed, and therefore high-frequency characteristics of the coaxial cable 33 will not be adversely affected by the press-connection of the shielding terminal 31.

The coaxial cable shielding terminal of the present invention is not limited to the construction of the above embodiment, and can take any other suitable form on the basis of the subject matter of the invention.

Figure 6:
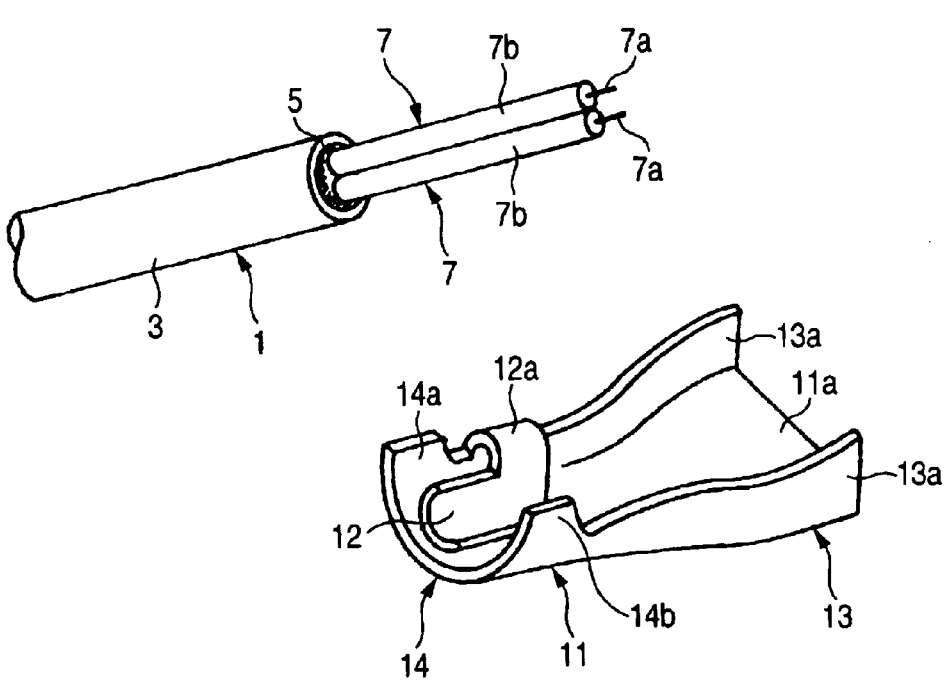
FIG. 6 is a perspective view of a conventional coaxial cable shielding terminal.
Figure 7:
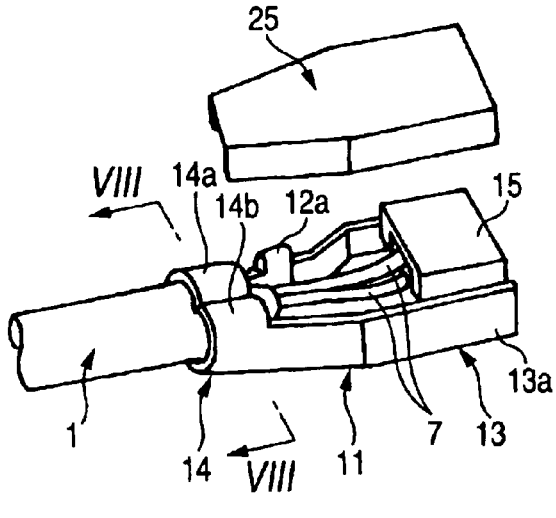
FIG. 7 is a perspective view showing a condition in which a coaxial cable is connected to the coaxial cable shielding terminal of FIG. 6.
Figure 8:
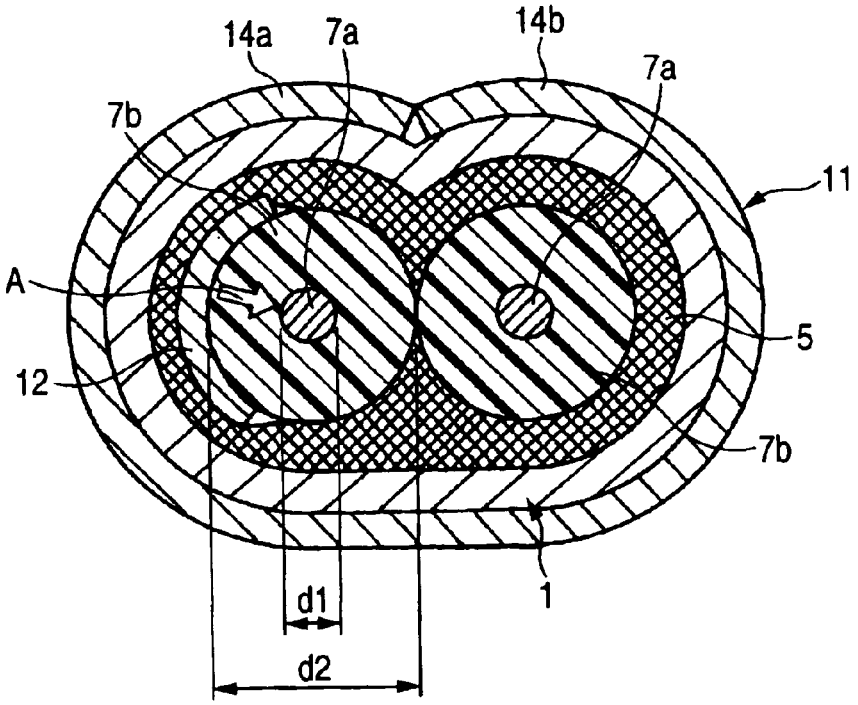
FIG. 8 is a cross-sectional view taken along the line VIII—VIII of FIG. 7.

For example, in the above embodiment, although the shielding terminal is press-connected to the end portion of the single-core coaxial cable 33, the invention can be applied to the case where a shielding terminal is connected to a two-core coaxial cable as shown in FIG. 6.

In the above embodiment, although the retaining portions 61 are formed by press forming (embossing), these retaining portions can be formed by other suitable means such for example as means for stamping and raising the relevant portions.

In the above embodiment, although the connection piece 55 extends from the upper portion of the terminal body 43 at the rear edge thereof, and is bent, a connection piece may be formed in a folded-back manner on the terminal side wall of the press-clamping portion via an interconnecting portion.

As described above, in the coaxial cable shielding terminal of the present invention, the connection piece is inserted between the braid and the inner insulating layer at the end portion of the coaxial cable, and in this condition the pair of braid press-fastening portions are press-fastened on the braid, and these braid press-fastening portions press and urge the braid toward the connection piece, so that the connection piece is held in intimate contact with the inner peripheral surface of the braid. Therefore, the braid is held between the connection piece and the braid press-fastening portions, so that the good electrically-connected condition can be obtained between the braid and the coaxial cable shielding terminal.

Although the press-fastening force, applied to the braid press-fastening portions during the press-connecting operation, presses and urges the braid and the connection piece toward the conductor core, the retaining portions, formed on and projecting from the inner surface of each of the braid press-fastening portions, limit the displacement of the connection piece toward the conductor core, and therefore there will not be encountered a situation in which the deformed connection piece squeezes the inner insulating layer.

Therefore, during the press-connecting operation, the squeezing of the inner insulating layer (within the coaxial cable) which disturbs an impedance will not occur, and therefore high-frequency characteristics of the coaxial cable will not be adversely affected by the press-connection of the shielding terminal.

What is claimed is:

1. A shielding terminal for a coaxial cable, comprising:

a press-clamping portion for being press-connected to an end portion of a coaxial cable, wherein said shielding terminal is electrically connectable to a braid of said coaxial cable exposed at the end portion thereof;

wherein said press-clamping portion includes a pair of braid press-fastening portions extending in a generally upstanding manner respectively from opposite side edges of a terminal bottom plate portion, and being press-connected to said braid by press-fastening, a connection piece inserted at a distal end portion thereof between an inner insulating layer of said coaxial cable and said braid from an end side of said coaxial cable so that said braid is held between said connection piece and distal end portions of said braid press-fastening portions, and a retaining portion projecting from an inner surface of at least one of said braid press-fastening portions to block the connection piece from being displaced toward a conductor core of said coaxial cable during the press-fastening operation.

2. A coaxial cable shielding terminal according to claim 1, wherein a plurality of said retaining portions are formed on the inner surface of said one braid press-fastening portion so as to be arranged generally in a longitudinal direction of said connection piece.

3. A coaxial cable shielding terminal according to claim 1, wherein at least one retaining portion is formed on each of the pair of the braid press-fastening portions so that the retaining portion on one braid press-fastening portion is opposed to the corresponding retaining portion on another braid press-fastening portion.

4. A coaxial cable shielding terminal according to claim 1, wherein the retaining portion is formed by pressing forming.

* * * * *